US010327487B2

(12) United States Patent
Peshek et al.

(10) Patent No.: US 10,327,487 B2
(45) Date of Patent: Jun. 25, 2019

(54) BODY-ENHANCING GARMENT AND GARMENT DESIGN

(71) Applicant: VF Corporation, Greensboro, NC (US)

(72) Inventors: Darren J. Peshek, Irvine, CA (US); Justin T. Mark, Irvine, CA (US); Brian Marion, Irvine, CA (US); Kyle Stephens, Irvine, CA (US); Donald Hoffman, Irvine, CA (US); Stephen H. Zades, Greensboro, NC (US)

(73) Assignee: VF Corporation, Greensboro, NC (US)

( * ) Notice: Subject to any disclaimer, the term of this patent is extended or adjusted under 35 U.S.C. 154(b) by 0 days.

(21) Appl. No.: 15/214,320

(22) Filed: Jul. 19, 2016

(65) Prior Publication Data

US 2018/0020752 A1 Jan. 25, 2018

(51) Int. Cl.

| | |
|---|---|
| ***A41B 1/00*** | (2006.01) |
| ***A41B 9/00*** | (2006.01) |
| ***A41D 1/00*** | (2018.01) |
| ***G06T 19/20*** | (2011.01) |
| ***A41D 27/08*** | (2006.01) |
| ***A41B 11/00*** | (2006.01) |
| ***A41C 3/00*** | (2006.01) |
| ***A41D 1/02*** | (2006.01) |
| ***A41D 1/06*** | (2006.01) |

(Continued)

(52) U.S. Cl.

CPC ..... *A41D 27/08* (2013.01); *A41B 1/00* (2013.01); *A41B 9/00* (2013.01); *A41B 11/00* (2013.01); *A41C 3/005* (2013.01); *A41D 1/02* (2013.01); *A41D 1/06* (2013.01); *A41D 1/08* (2013.01); *A41D 1/14* (2013.01); *A41D 1/22* (2013.01); *A41D 7/00* (2013.01); *A41H 3/007* (2013.01); *A41H 3/04* (2013.01); *A43B 3/0036* (2013.01); *A41D 2400/38* (2013.01)

(58) Field of Classification Search

None

See application file for complete search history.

(56) References Cited

U.S. PATENT DOCUMENTS

| | | | |
|---|---|---|---|
| 1,654,064 | A | 12/1927 | Zaki |
| 1,697,255 | A | 1/1929 | Wolff |

(Continued)

FOREIGN PATENT DOCUMENTS

| | | |
|---|---|---|
| CN | 3546110 | 7/2006 |
| CN | 301869010 | 3/2010 |

(Continued)

OTHER PUBLICATIONS

Spoon Graphics "8 Free Stipple Shading Brushes for Adobe Illustrator", May 25, 2015 , https://blog.spoongraphics.co.uk/freebies/8-free-stipple-shading-brushes-for-adobe-illustrator.*

(Continued)

*Primary Examiner* — Tize Ma

(74) *Attorney, Agent, or Firm* — Smith, Gambrell & Russell LLP

(57) ABSTRACT

Systems or methods for anatomy patterning a garment are provided. Anatomy patterning is any deliberate manipulation of a garment's pattern in order to change the perceived shape of a wearer of the garment toward a desired appearance. Additionally, the garments that result from use of these systems and methods for anatomy patterning are also provided.

2 Claims, 18 Drawing Sheets

(51) Int. Cl.

| | |
|---|---|
| ***A41D 1/08*** | (2018.01) |
| ***A41D 1/14*** | (2006.01) |
| ***A41D 1/22*** | (2018.01) |
| ***A41D 7/00*** | (2006.01) |
| ***A41H 3/00*** | (2006.01) |
| ***A43B 3/00*** | (2006.01) |
| ***A41H 3/04*** | (2006.01) |

(56) References Cited

U.S. PATENT DOCUMENTS

| | | | | |
|---|---|---|---|---|
| 1,817,053 | A | 8/1931 | Zerk | |
| 1,852,138 | A | 4/1932 | Zerk | |
| 2,381,580 | A | 8/1945 | Einbinder | |
| 2,718,640 | A | 9/1955 | Suckle | |
| 2,840,824 | A | 7/1958 | Horner | |
| 3,683,419 | A | 8/1972 | Lewis | |
| 3,691,971 | A | 9/1972 | Clarke | |
| 3,696,845 | A | 10/1972 | Acker et al. | |
| D259,820 | S | 7/1981 | Heinfling | |
| 4,282,609 | A | 8/1981 | Freedman et al. | |
| 4,888,713 | A | 12/1989 | Falk | |
| 5,065,458 | A | 11/1991 | Johnson | |
| 5,535,451 | A | 7/1996 | Tassone | |
| 5,990,444 | A | 11/1999 | Costin | |
| 6,175,966 | B1 | 1/2001 | Wiesenthal | |
| 7,058,987 | B2 | 6/2006 | Salazar | |
| 7,107,621 | B2 | 9/2006 | Meekins | |
| D558,954 | S | 1/2008 | Lew | |
| D586,084 | S | 2/2009 | Mendoza | |
| 7,814,576 | B2 | 10/2010 | Nakazawa | |
| D650,154 | S | 12/2011 | Saavedra | |
| 8,869,313 | B2 | 10/2014 | Maramotti | |
| 8,959,665 | B1 | 2/2015 | Garner | |
| 8,984,668 | B2 | 3/2015 | Tulin | |
| 9,326,552 | B2 | 5/2016 | Hays | |
| D768,359 | S | 10/2016 | Lago | |
| 9,468,239 | B2 | 10/2016 | Battah | |
| D793,033 | S | 8/2017 | Neary | |
| 9,801,420 | B2 | 10/2017 | Hays | |
| D802,256 | S | 11/2017 | Peshek | |
| 2004/0205879 | A1 | 10/2004 | Leba | |
| 2006/0235656 | A1 | 10/2006 | Mochimaru et al. | |
| 2007/0266478 | A1 | 11/2007 | Girod | |
| 2008/0271226 | A1 | 11/2008 | Erana | |
| 2009/0157021 | A1 | 6/2009 | Sullivan et al. | |
| 2010/0136882 | A1 | 6/2010 | Malish | |
| 2011/0010818 | A1 | 1/2011 | Hood | |
| 2011/0185477 | A1 | 8/2011 | Olenicoff | |
| 2011/0214216 | A1 | 9/2011 | Zarabi | |
| 2012/0023644 | A1 | 2/2012 | Maramotti | |
| 2014/0165265 | A1 | 6/2014 | Tulin | |
| 2014/0182044 | A1 | 7/2014 | Cole | |
| 2014/0273742 | A1 | 9/2014 | Hays | |
| 2015/0082516 | A1 | 3/2015 | Doan | |
| 2015/0106993 | A1* | 4/2015 | Hoffman | A41D 1/06 2/69 |
| 2015/0196068 | A1 | 7/2015 | Tulin | |
| 2015/0213646 | A1* | 7/2015 | Ma | G06T 17/20 345/420 |
| 2015/0339853 | A1* | 11/2015 | Wolper | G06T 17/00 345/423 |
| 2016/0189431 | A1* | 6/2016 | Ueda | G06T 19/006 705/26.8 |
| 2016/0227854 | A1* | 8/2016 | Ellis | A41D 27/08 |
| 2016/0324234 | A1 | 11/2016 | Hoffman et al. | |
| 2018/0014583 | A1 | 1/2018 | Peshek | |
| 2018/0014590 | A1 | 1/2018 | Peshek | |
| 2018/0110273 | A1 | 4/2018 | Peshek | |
| 2018/0168256 | A1 | 6/2018 | Peshek | |

FOREIGN PATENT DOCUMENTS

| | | |
|---|---|---|
| CN | 301600315 | 7/2011 |
| CN | 302245662 | 12/2012 |
| CN | 302245667 | 12/2012 |
| CN | 302554428 | 9/2013 |
| FR | 2876880 | 4/2006 |
| JP | 2004156153 | 6/2004 |
| WO | 2006032096 | 3/2006 |
| WO | 2007055072 | 5/2007 |
| WO | 2007112494 | 10/2007 |
| WO | 2012004365 | 1/2012 |
| WO | 20130154445 | 10/2013 |
| WO | 2018017732 | 1/2018 |

OTHER PUBLICATIONS

PCT International Search Report in PCT/US2017/042885, dated Sep. 11, 2017, 14 pages.

PCT International Search Report in PCT/US2017/042888, dated Sep. 11, 2017, 15 pages.

PCT Invitiation to Pay Additional Fees in PCT/US2017/0422000, dated Sep. 20, 2017, 15 pages.

"Truly WOW Slim Leg Jeans Long Simply Be", Aug. 1, 2012, 3 pages, http://www.simplybe.co/uk/shop/truly-wow-slimleg-jeans-long.co.uk/shop/truly-wow-slim-leg-jeans-long/qy094/product/details/show.action?pdBoUiD=5205#colour;size.

Anonymous, "Kilowog muscle suit", Aug. 3, 2010, XP055371226, http://theleagueofheroes.yuku.com. Retreived from the Internet: http://theleagueofheroes.yuku.com/topic9266/Kilowog-muscle-suit#.WRL4-HpMek5, 7 pages.

European Extended Search Report in Application 14854060.2, dated May 18, 2017, 9 pages.

PCT International Search Report in PCT/US2017/042200, dated Nov. 28, 2017, 22 pages.

Cuenca-Guerra, et al., "What makes Buttocks Beautiful" A Review and Classification of the Determinants of Gluteal Beauty and the Surgical Techniques to Achieve Them, Aesthetic Plastic Surgery, 2004 Springer Science+Business Media, Inc. 2004.

Hoffman, "Visual Intelligence: How We Create What We See", Published by W.W. Norton, 2000.

PCT International Search Report in PCT/US2014/061277, dated Jan. 27, 2015, 10 pages.

Lee Jeans, The Geek Lounge, Jun. 4, 2014, https://geek.lounge.wordpress.com/tag/lee-jeans.

Men's Jeans and women's jeans and denim jacket measurements to check or make your own pattern, Oct. 11, 2007, https://web.archive.org/web/20071011004827/http://www.jeansinfo.org/measurements.html.

PCT International Search Report in PCT/US2018/017967, dated Apr. 26, 2018, 14 pages.

* cited by examiner

BODY-ENHANCING GARMENT AND GARMENT DESIGN

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

INTRODUCTION

It is common for clothing manufactures to construct garments with visible patterns on the garments. These patterns will form lines or details that fall on the wearer's body.

It is with respect to these and other general considerations that aspects disclosed herein have been made. In addition, although relatively specific problems may be discussed, it should be understood that the aspects should not be limited to solving the specific problems identified in the background or elsewhere in this disclosure.

SUMMARY

This disclosure generally relates to systems and methods for anatomy patterning. More specifically, anatomy patterning is any deliberate manipulation of a pattern applied to a garment in order to change the perceived shape of a wearer of the garment toward a desired appearance. Additionally, the disclosure generally relates to the garments that result from use of these systems and methods for anatomy patterning.

In one aspect, the disclosure is directed to a body-enhancing garment. The body-enhancing garment includes a front side, a rear side, and an adjusted pattern. The rear side is opposite the front side. The adjusted pattern is displayed on at least one of the front side and the rear side. Further, the adjusted pattern is manipulated around a first feature of a wearer to change a perceived shape of the first feature of the wearer toward a desired first feature shape.

In another aspect, the disclosure is directed to a method for designing a body-enhancing garment. The method includes:

- identifying a desired 3-D body shape;
- identifying a flat pattern for a garment;
- adjusting the flat pattern based on the desired 3-D body shape and a selected shaping effect to create an adjusted pattern;
- creating a 2-D image of the adjusted pattern; and
- applying the adjusted pattern to the garment based on the 2-D image of the adjusted pattern to form the body-enhancing garment.

In yet another aspect, the disclosure is directed to a method for designing a body-enhancing garment. The method includes:

- applying a flat grid to or bending the flat grid around an actual 3-D body shape and around a desired 3-D body shape of a selected body feature to form two different bent grids;
- positioning a selected pattern over each of the grids;
- finding curve differences between grid positions of the two different bent grids at corresponding locations of the positioned selected pattern on each of the grids; and
- utilizing these determined curve differences to adjust the selected pattern at the corresponding grid locations.

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

These and other features and advantages will be apparent from a reading of the following detailed description and a review of the associated drawings. It is to be understood that both the foregoing general description and the following detailed description are illustrative only and are not restrictive of the claims.

BRIEF DESCRIPTION OF THE DRAWINGS

Non-limiting and non-exhaustive examples or aspects are described with reference to the following Figures.

DETAILED DESCRIPTION

In the following detailed description, references are made to the accompanying drawings that form a part hereof, and in which are shown by way of illustrations specific embodiments or examples. These embodiments or examples may be combined, other embodiments or examples may be utilized, and structural changes may be made without departing from the spirit or scope of the present disclosure. The following detailed description is therefore not to be taken in a limiting sense, and the scope of the present disclosure is defined by the appended claims and their equivalents.

Figure 1:
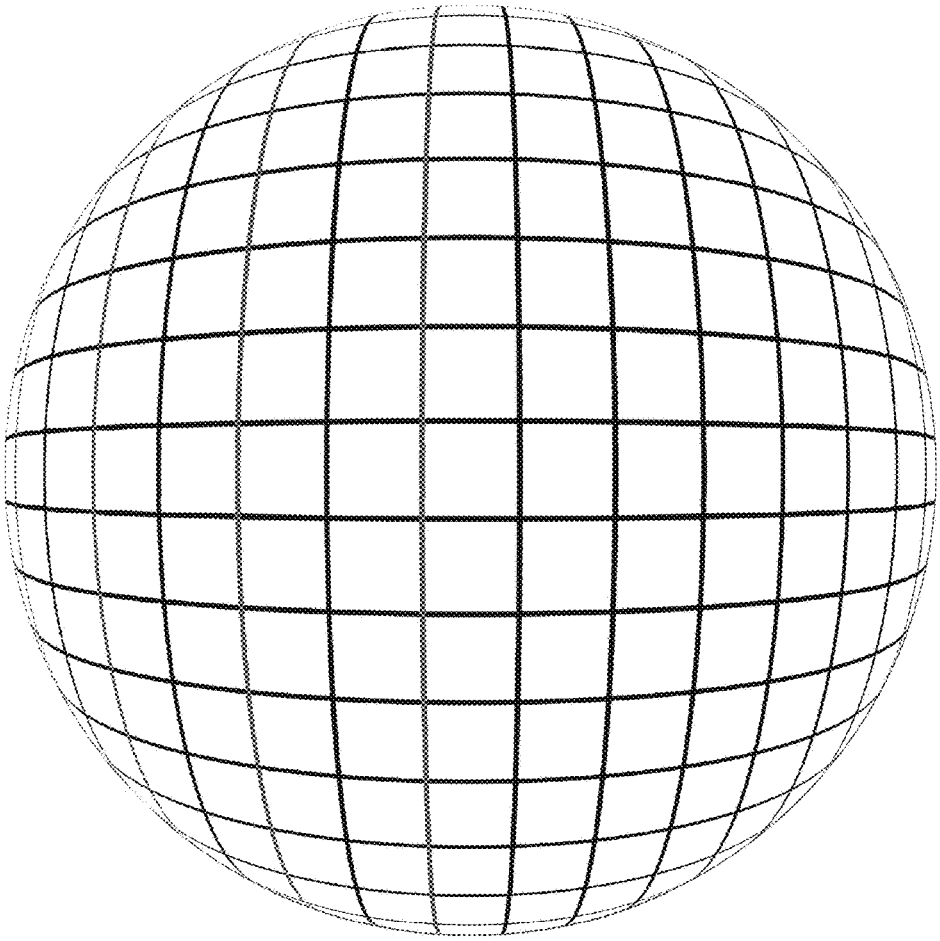
FIG. 1 is a two-dimensional picture illustrating a rule of perception (geodesic assumption) utilized by the brain, in accordance with an aspect of the disclosure.

Each time humans open their eyes, their brains performs trillions of computations in order to see a three-dimensional (3-D) world. These computations operate according to a set of rules. One of these rules is the geodesic assumption: Curved lines on a surface reveal 3-D shape of that surface. This is why, a person looking at FIG. 1 cannot help but see a 3-D shape even though the lines are, of course, flat. Specifically, FIG. 1 is a two-dimensional image that consists of only curved lines. The visual system, utilizing the geodesic assumption, assumes that lines on a surface curve due to the 3-D shape of the surface. Accordingly, the brain interprets the curved lines as laying on the surface of a sphere, which is viewed as coming out of the page.

Further rules utilized by the visual system include foreshortening cues and scaling gradients. Scaling gradients refer to the local size of the pattern elements such that larger elements are generally perceived as being on a surface that is closer to the observer, while smaller elements are generally perceived as being on a surface that is further from the viewer. Foreshortening cues can provide additional information about slant, tilt, and curvature of a surface. For example, if a flat pattern consisting of circular elements is distorted in depth then areas that are slanted or tilted away from the observer will feature ellipses rather than circles. The visual system can use the width of the ellipses as an additional cue when constructing a 3-D shape of the surface. For instance, foreshortening cues are visible in the bust of FIG. 1504 and FIG. 1304. These cues lead to the perception that the pattern is on a 3-D surface.

Figure 2:
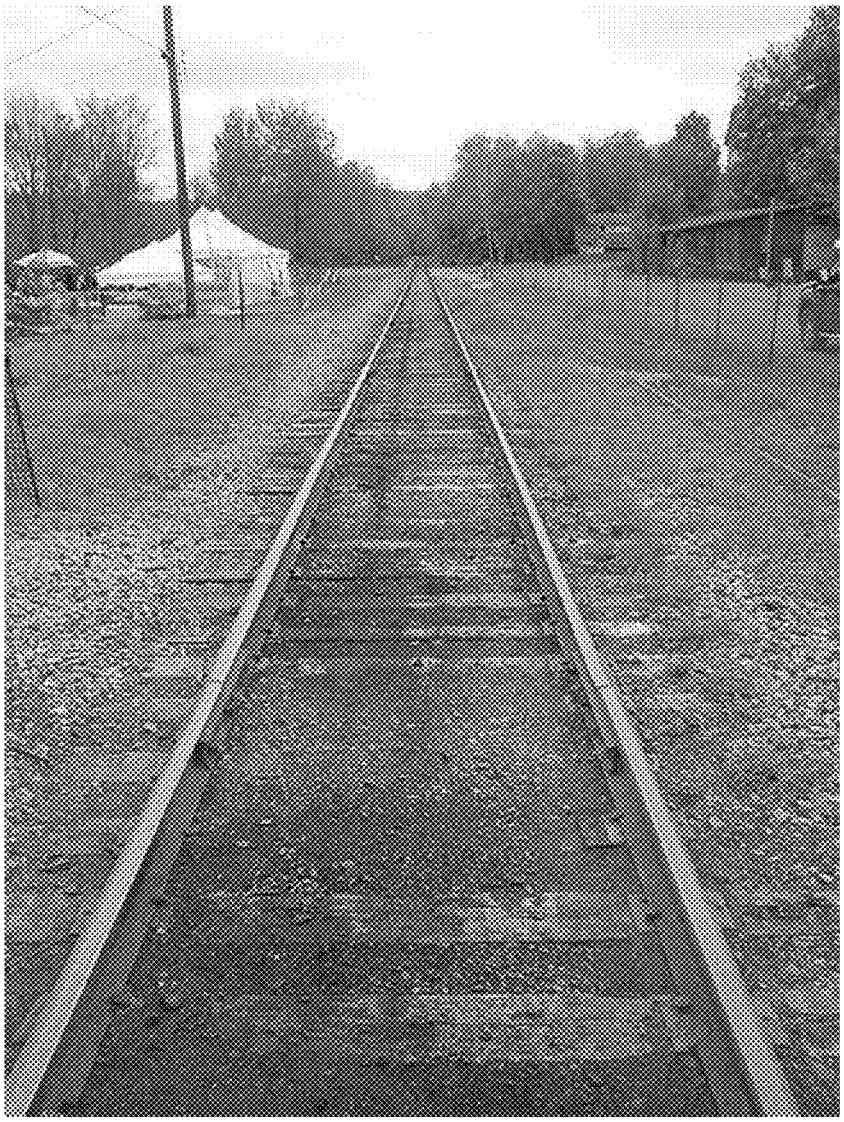
FIG. 2 is a two-dimensional picture illustrating a rule of perception (linear perspective) utilized by the brain, in accordance with an aspect of the disclosure.

Another rule utilized by the visual system is linear perspective. An example of linear perspective is shown in FIG. 2 where parallel train tracks converge as they recede into the distance. This depth cue utilizes the fact that as objects move further away their visual angle decreases. Therefore, if we take the distance between the train tracks as our object, then the bottom of the image, where the train tracks are very wide, appears close to the viewer, while the top of the image where the train tracks are very narrow, appears far from the viewer. The image presented in FIG. 2 is two-dimensional (2D), so the perception of depth is entirely constructed by the visual system, primarily utilizing the linear perspective cue.

Figure 3:
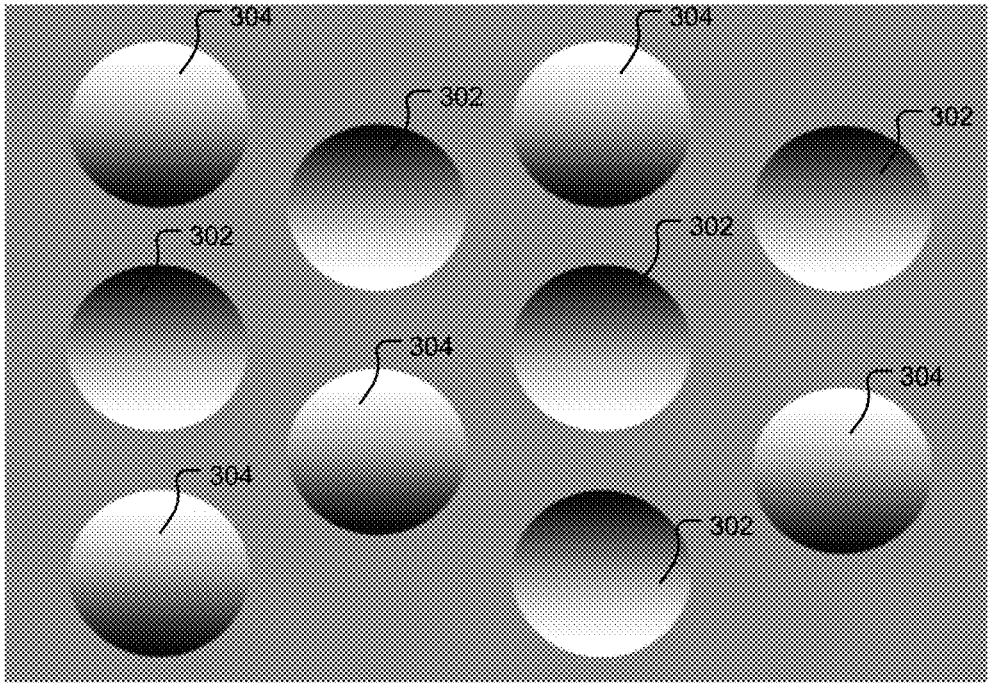
FIG. 3 is a two-dimensional picture illustrating a rule of perception (shape from shading) utilized by the brain, in accordance with an aspect of the disclosure.

Another rule utilized by the visual system relates to how the brain uses brightness gradients to construct and perceive 3-D shapes. This rule is known as shape from shading and an example of this rule is illustrated in FIG. 3. When looking at FIG. 3 the visual system assumes that light generally comes from overhead and thus interprets the first set of five circles 302 as depressions extending into the page and the second set of five circles 304 as bumps extending out from the page. The brain makes these determinations based on the brightness gradients of the circles 302 and 304 and the assumption of an overhead light source. For instance, when FIG. 3 is viewed upside down, the brain perceives the first set of five circles 302 as bumps extending out from the page and the second set of five circles 304 as depressions extending into the page all because the shading of the circles have switch positions. As such, changes in shading can significantly affect how the brain perceives an object.

Many garments are constructed with visible patterns on the fabric. These patterns typically utilize symmetrical, straight, and/or repeating details or pattern elements and have no intentional brightness gradients when the garments are laid flat. Additionally, patterns may include illusory details or lines created within the negative space between the pattern elements, and serve as an informative element of the pattern itself. These patterns become curved and shaded when worn on the body. The visual system assumes that the curvature and/or brightness gradients of those patterns is attributed entirely to the body shape (i.e., that curved lines of the pattern on the garment would be straight lines if the garment was laid flat). Thus, using the rules of perception, the visual system constructs a three-dimensional body shape based in part on the curvature, size, and shading of the pattern.

It is known from the field of evolutionary psychology that each time an individual encounters a person, the individual's brain automatically evaluates a multitude of sensory cues relating to the health and reproductive fitness of the person within a fraction of a second. The individual's initial judgment of attractiveness is a summary of that evaluation, with individuals who appear healthier and more reproductively fit being perceived as more attractive. Therefore, the three-dimensional shape of a person's body is a critical sensory cue that is used to assess the attractiveness of the person.

When a person wears clothing, he or she voluntarily puts patterned clothing on his or her body. The brain interprets the lines, spacing, sizing, and other elements of the pattern using the rules discussed above and other rules known within the field of vision science. Current clothing designs do not take into account that the brain uses these patterns on garments to construct a 3D shape of the wearer. As such, a problem with existing garment construction or design is that it can create garments that make an individual's form less attractive to others, a result that is typically not desired by the individual wearing the garment. While the rules of perception have been heavily studied, these rules have not been applied to clothing. Further, the rules of perception have not been utilized on a garment to change the perception of a human feature to fall within or move toward known attractive size and shape ranges and/or desired size and shape ranges when worn.

As such, there is typically no system or method that utilizes the rules of perception and desired feature ranges to design or manufacture clothing. Therefore, the systems and methods disclosed herein provide systems and/or methods for systematically applying patterns on garments, using the rules of perception, to change the perceived shape of the wearer. The changes to the patterns are based on the anatomy of any wearer and are referred to herein as anatomy patterning. In some embodiments, anatomy patterning is used to increase the attractiveness of the wearer. For instance, an attractive body will bend and/or shade a pattern differently than an unattractive body. Thus, the systems and methods as disclosed herein may adjust a pattern on a flat garment based on the curves and shading created by an attractive body to change the perception of the 3-D shape of the wearer in such a way that the wearer is perceived as more attractive. However, in other embodiments, anatomy patterning is used to change the appearance of the wearer toward any desired feature shape.

The feature of the body may cover any human body part or area, such as the buttocks, legs, chest, waist, feet, hips, etc. This list is exemplary only and is not meant to be limiting. Garments include any clothing item that can be worn by a human, such as pants, shirts, skirts, jackets, shorts, skirts, dresses, leggings, capris, bras, underwear, swim wear, shoes, skorts, outerwear, and etc. This list is exemplary only and is not meant to be limiting.

Knowing that the brain automatically constructs a 3-D shape from the pattern and shading on a wearer, the shape, size, shading and/or positioning of the pattern can be adjusted to change the perceived shape of the wearer. The field of plastic surgery has identified several properties of the shape of the female buttocks and other human features that are considered attractive. As such, the patterning could, for example, be adjusted to change the perceived shape of the wearer of the garment to appear more attractive or to appear closer to these known plastic surgery properties.

Referring now to the drawings, in which like numerals represent like elements through the several figures, various aspects of the present disclosure will be described.

Several different processes or methods may be utilized to anatomy-pattern garments. In some embodiments, anatomy patterning may be performed by adjusting a pattern on clothing based on the rules of perception (such as the principles of the geodesic assumption) after visible inspection on live models. In other embodiments, anatomy patterning is based on a difference in curves found between an actual body shape of a selected feature and a desired body shape for that selected feature. In other embodiments, a method 500 for anatomy patterning may be utilized as illustrated in FIG. 5.

FIGS. 5A-5E are flow diagrams illustrating a method 500 for designing an anatomy-patterned garment, in accordance with an aspect of the disclosure. Anatomy patterning uses the rules of perception to change a perceived size and/or shape of the anatomy of the wearer. In some embodiments, anatomy patterning is used to increase the attractiveness of the wearer. FIGS. 4-10 and 13-16 illustrate schematic examples of different operations of method 500 for anatomy patterning a pair of pants to change the appearance of a buttocks and legs.

Figure 6:
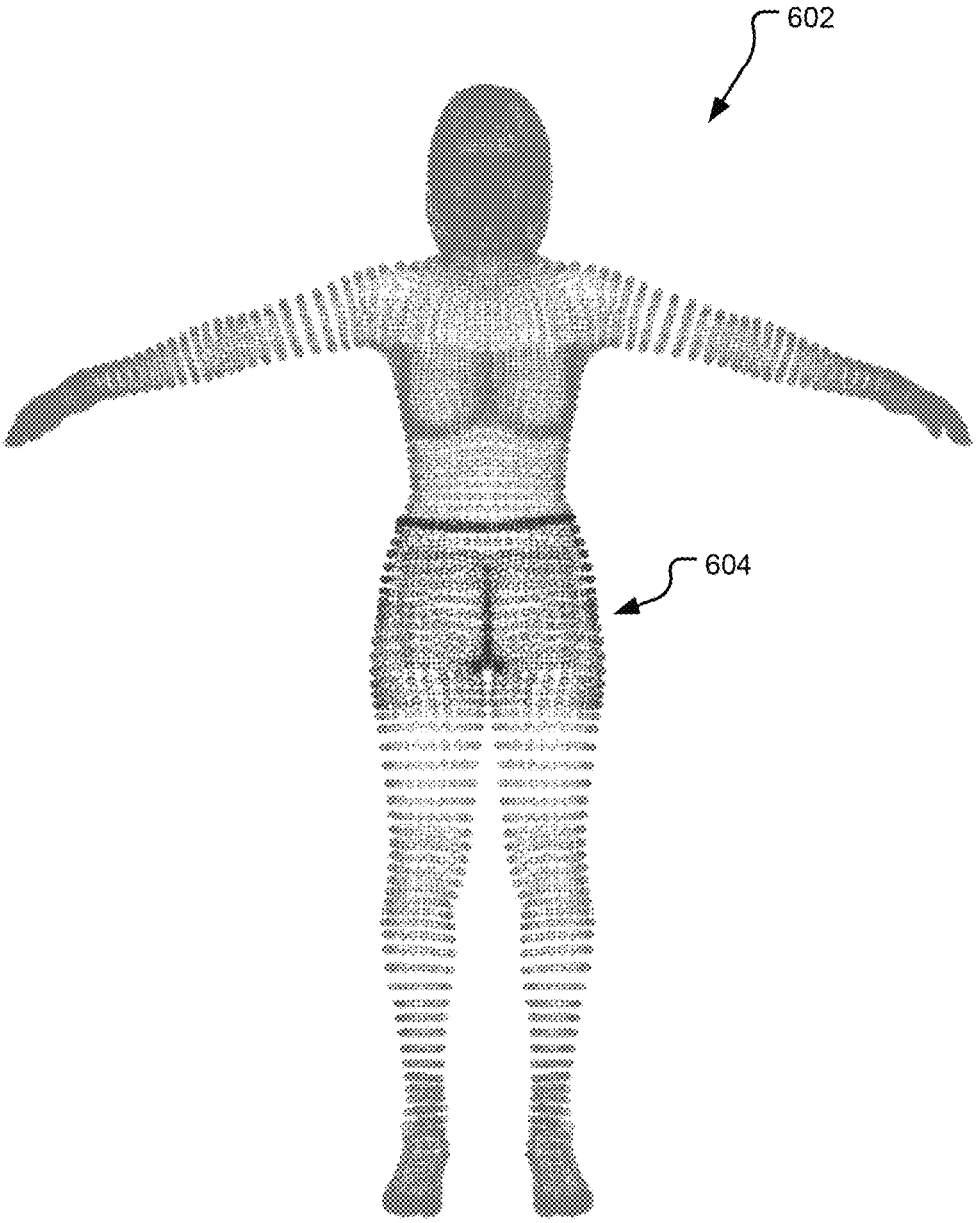
FIG. 6 is a rear view illustrating a computer generated desired three-dimensional body shape for the buttocks, in accordance with an aspect of the disclosure.

The routine or method 500 begins at operation 502, where a desired 3-D body shape is identified. The desired 3-D body shape may include one or more features of the body. A feature may be any body part or area of the body that is covered by a selected garment. For example, the feature may be the buttocks and/or the legs. In some embodiments, the desired 3-D body shape is generated by one or more computing devices. In some embodiments, the desired 3-D body shape is an attractive body shape based on known attractive size and shape ranges. In other embodiments, the desired 3-D body shape accentuates or minimizes the appearance of a specific feature of the body. For example, the desired body shape may be any desired range of sizes and/or shapes for one or more features. FIG. 6 illustrates an example of a computer generated desired 3-D body shape 602 for the buttocks 604.

After the 3-D body shape is identified during operation 502, method 500 moves to operation 504. At operation 504, a pattern or flat pattern for the selected garment is identified. For example, FIG. 4 illustrates an example of a flat pattern 402 and FIG. 8 illustrates a flat pattern 802.

Next, operation 506 is performed. At operation 506, the pattern is adjusted based on the desired 3-D body shape and based on one or more selected shaping effects to create an adjusted pattern. The one or more selected shaping effects may be warping, shading, halftoning, and/or stippling the pattern.

Figure 4:
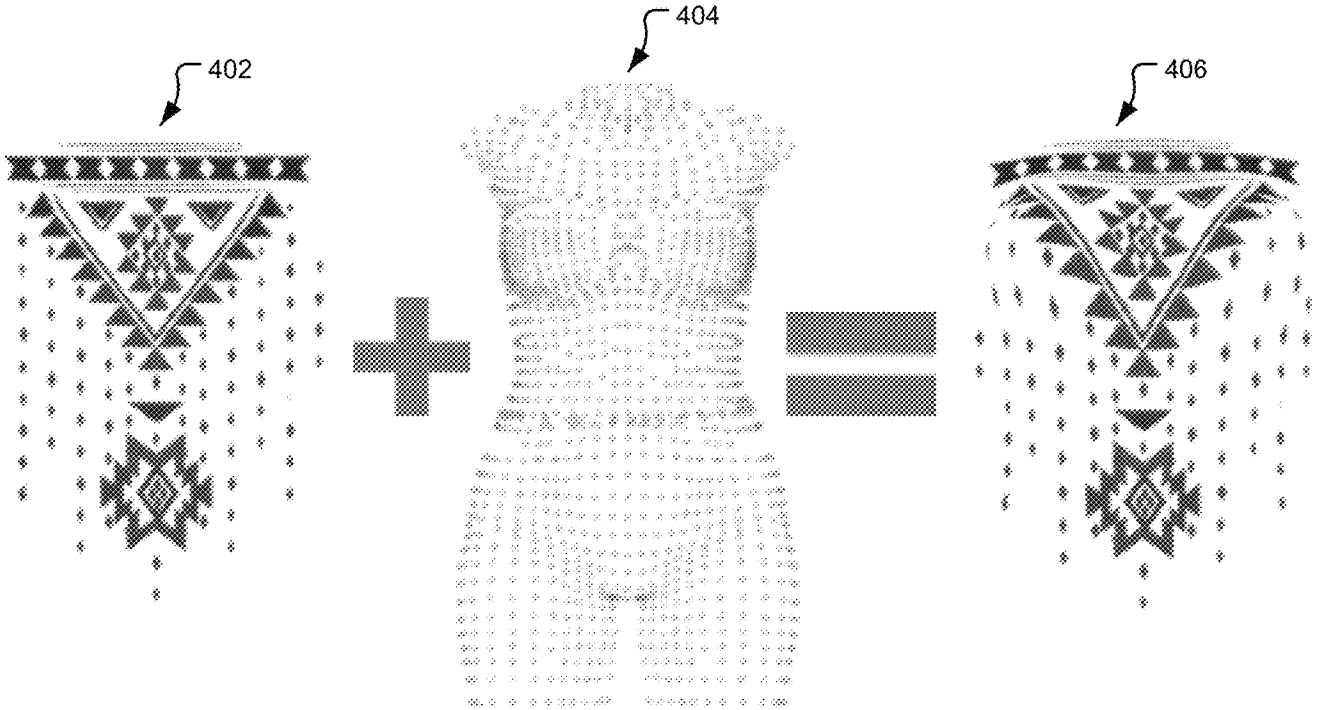
FIG. 4 is a schematic flow diagram illustrating a computer-generated conversion of a flat pattern to an adjusted pattern based on a desired body shape, in accordance with an aspect of the disclosure.
Figure 5A:
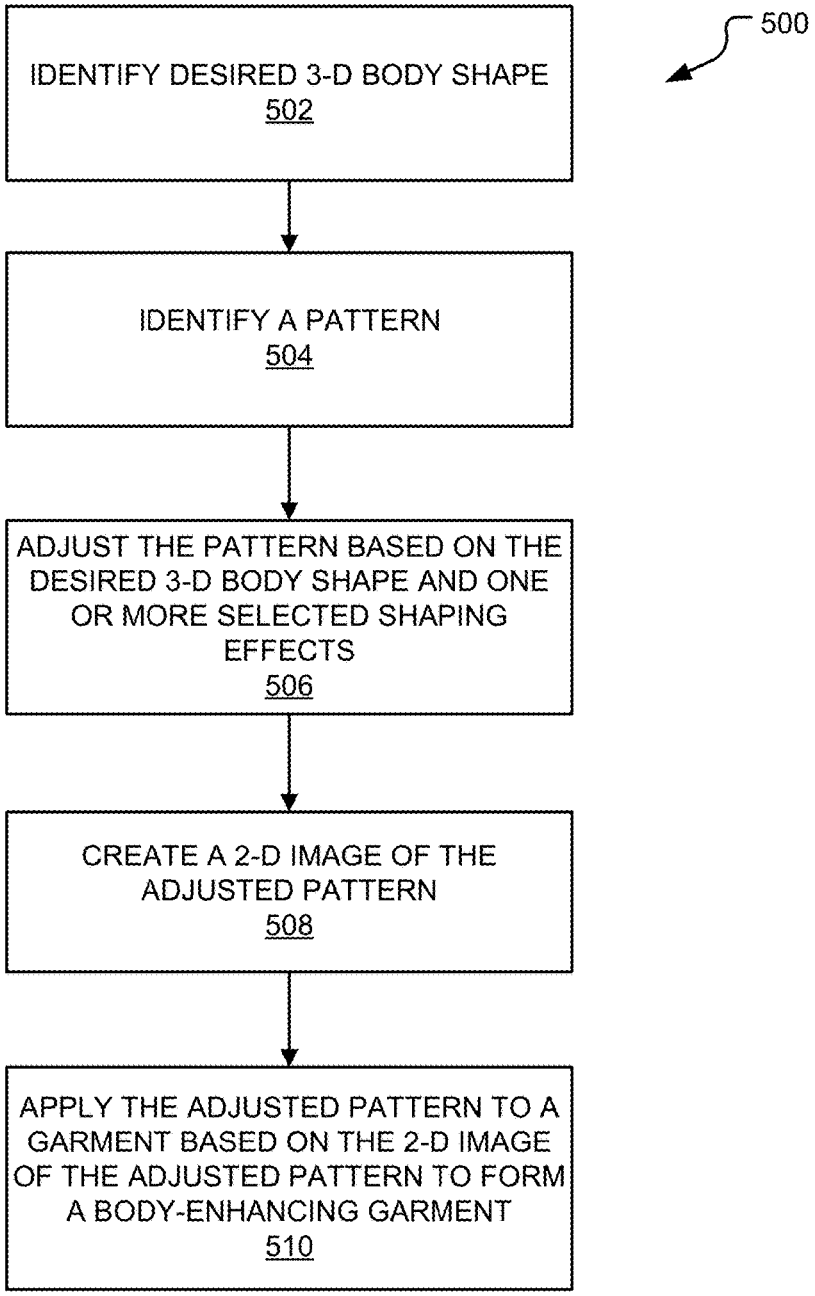
FIGS. 5A-5E are flow diagrams illustrating a method for designing an anatomy-patterned garment or a body-enhancing garment, in accordance with an aspect of the disclosure.
Figure 5B:
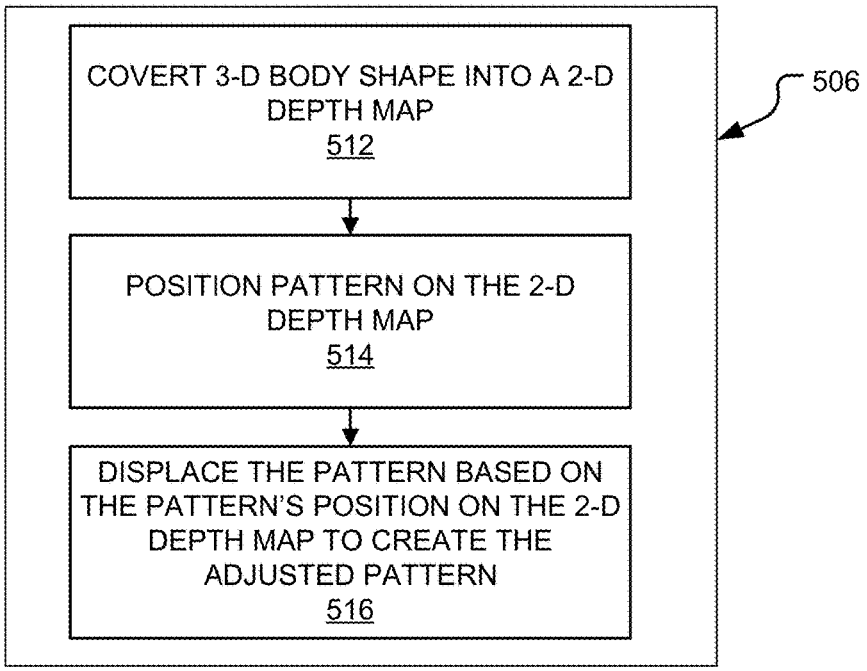
Figure 8:
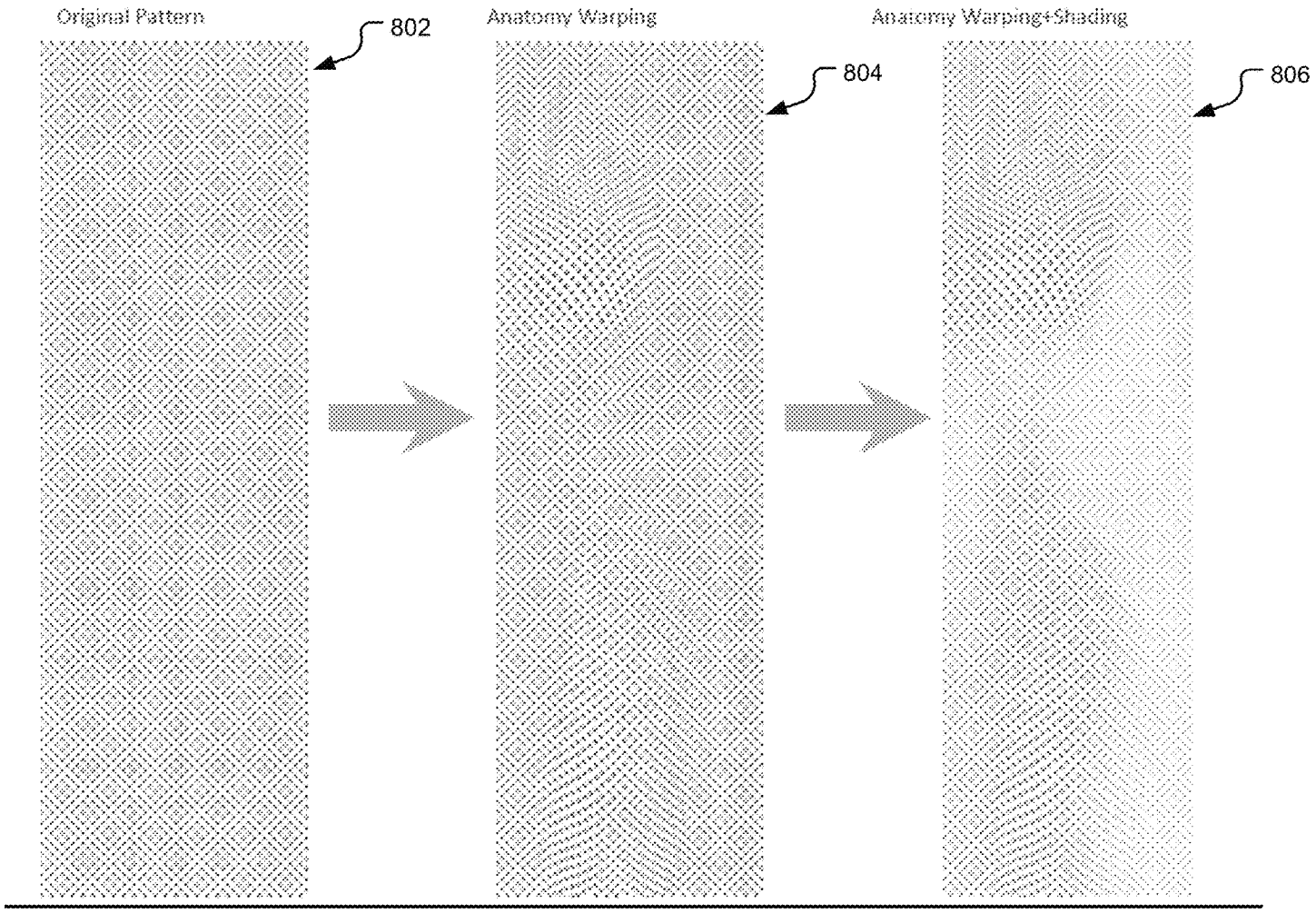
FIG. 8 is a schematic flow diagram illustrating a flat pattern and the adjustment of the flat pattern into an anatomy warped adjusted pattern and the adjustment of the anatomy warped adjusted pattern into an anatomy warped and shaded adjusted pattern, in accordance with an aspect of the disclosure.

Warping the pattern involves adjusting the provided pattern based on the curves of a desired body shape as illustrated by the warped pattern 406 in FIG. 4 and the warped pattern 804 in FIG. 8. For example, when one or more selected shaping effects is warping, operations 512-516 are performed at operation 506 as illustrated by FIG. 5B. In some embodiments, operations 512-516 are performed by one or more computing devices.

Figure 7:
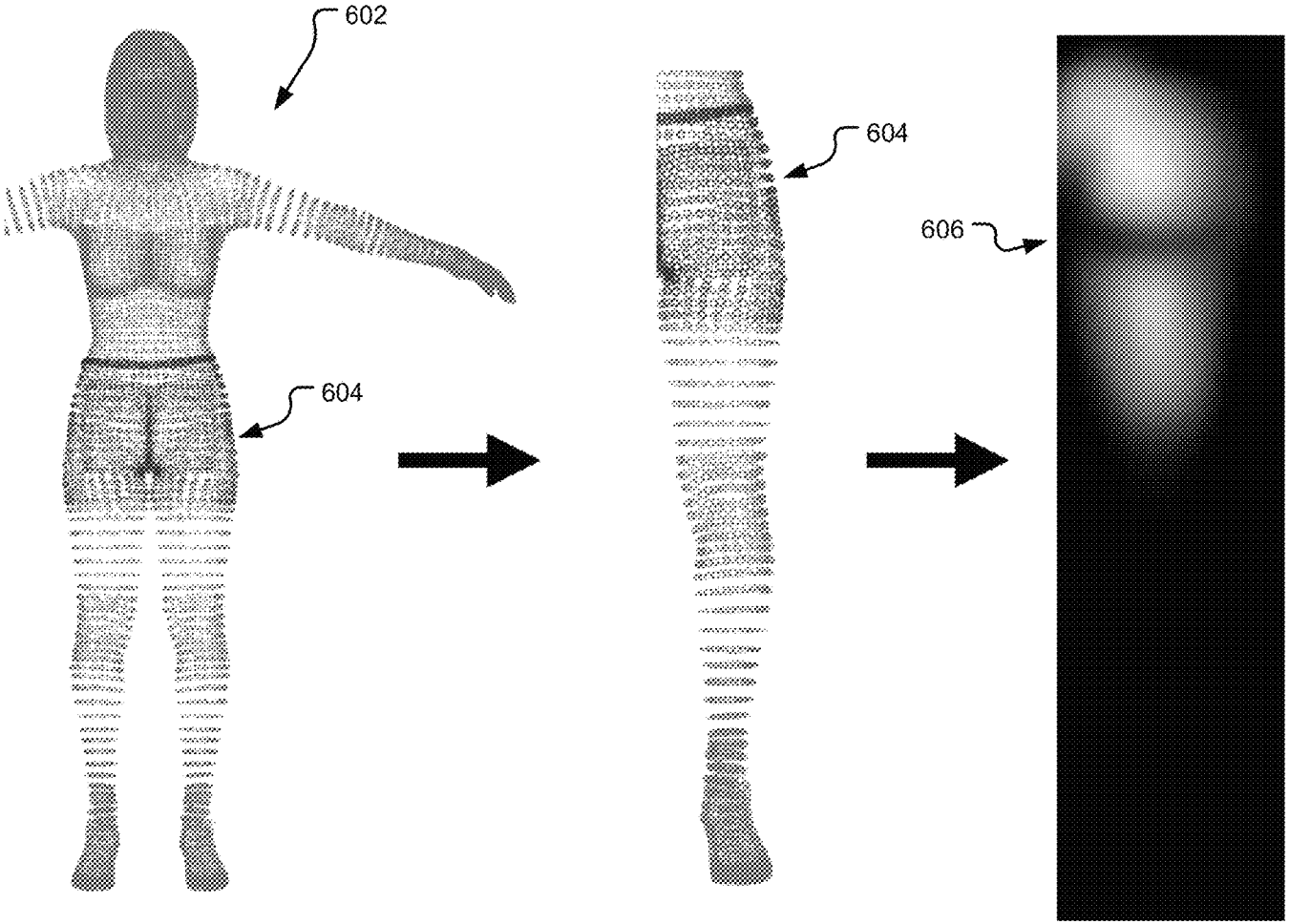
FIG. 7 is a schematic flow diagram illustrating a computer-generated conversion of the desired three-dimensional body shape of the buttocks shown in FIG. 6 to a two-dimensional depth map, in accordance with an aspect of the disclosure.
Figure 9:
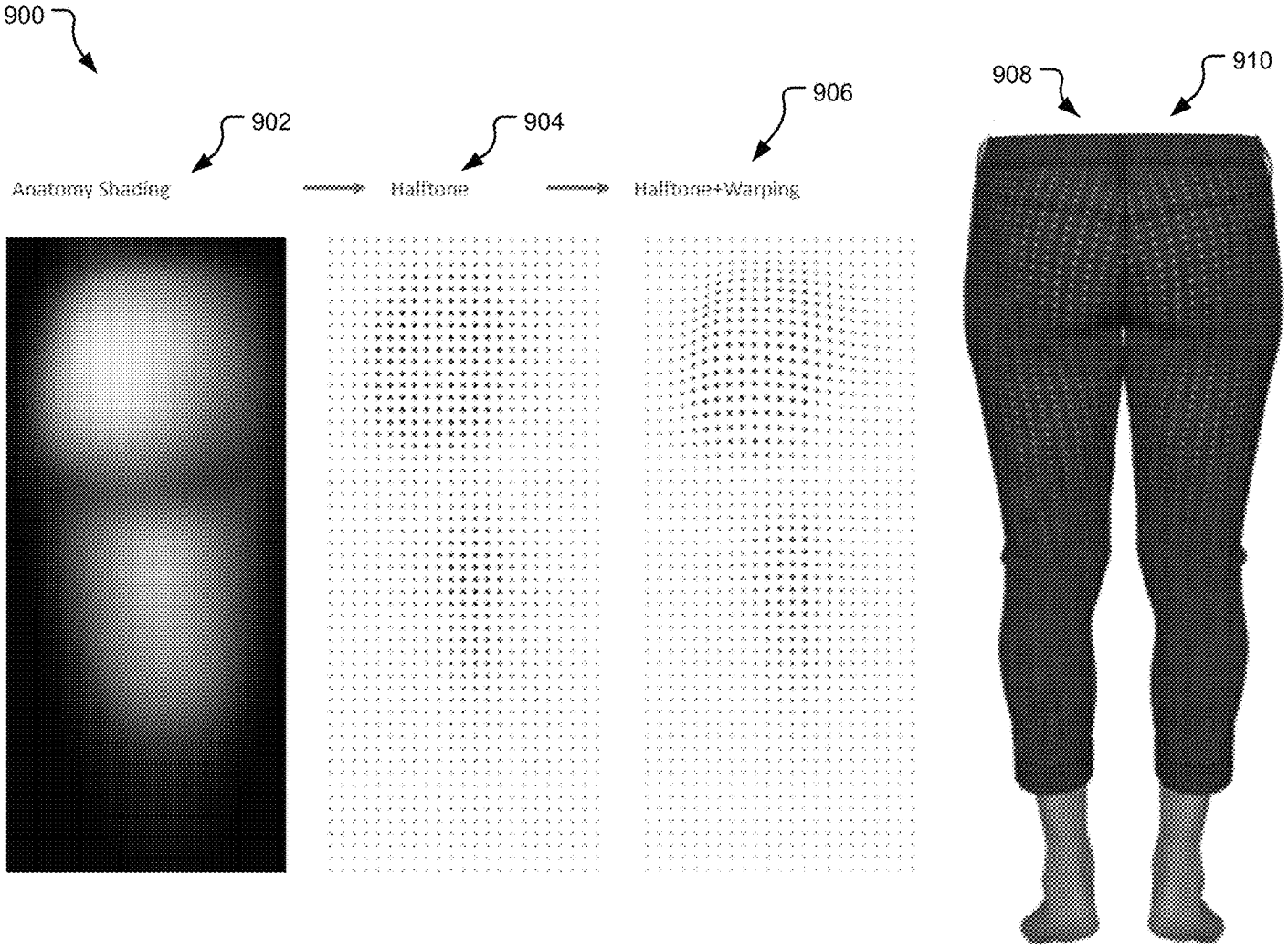
FIG. 9 is a schematic flow diagram illustrating the adjustment of a flat pattern utilizing a 2-D depth map of a desired body shape to form a halftoned adjusted pattern and the adjustment of the halftoned adjusted pattern into a halftoned and anatomy warped adjusted pattern, and the application of the halftone and anatomy warped adjusted pattern to a garment to form a body-enhancing garment, in accordance with an aspect of the disclosure.

At operation 512, the desired 3-D body shape is converted into a 2D depth map. In some embodiments, the 2D depth map of the desired 3-D body shape is generated by one or more computing devices. For example, FIG. 7 illustrates an example of a computer-generated conversion of the desired 3-D body shape 602 of the buttocks 604 to a 2D depth map 606. FIG. 9 also illustrates another example of a 2D depth map 902 for a desired body shape.

Next, operation 514 is performed. At operation 514, the identified or selected pattern is positioned on the 2D depth map 606 of the desired 3-D body shape. In some embodiments, the size of the pattern is also determined at operation 508. The positioning at operation 514 ensures that the pattern falls over or near a selected feature of a body appropriately when worn. In some embodiments, operation 504 is performed by one or more computing devices.

After the performance of operation 514, operation 516 is performed. At operation 516 the pattern is displaced based on the flat pattern's position on the 2D depth map to create the adjusted pattern. Accordingly, in these embodiments, the pattern is displaced according to the 2D depth map at operation 514 to show the curves that would be created on the flat pattern if it were being worn by a body with the desired 3-D body shape.

FIG. 4 illustrates an example of how a flat pattern 402 can be warped based on a desired feature shape 404 to create an anatomy-warped pattern 406. This anatomy-warped pattern 406 may be applied to a flat garment. A person wearing the garment with the anatomy-warped pattern 406 will appear to have or to be shaped similarly to the desired body shape 404 based on the wearing of this anatomy-warped pattern 406.

Figure 5C:
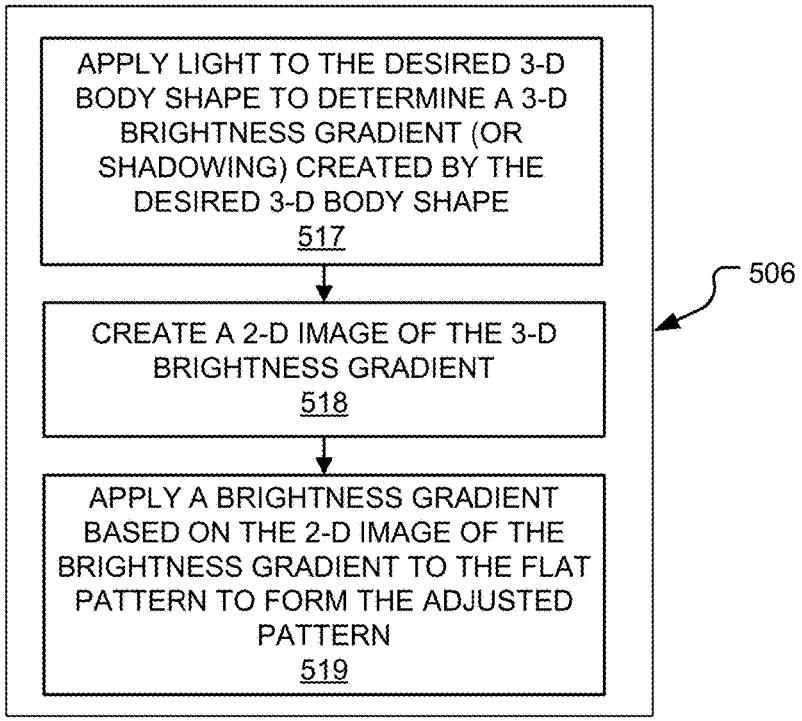

Shading the pattern involves adjusting the local brightness of the provided pattern based on the 3D brightness gradients of a desired body shape as illustrated by the warped and shaded pattern 806 in FIG. 8. For example, when one or more selected shaping effects includes shading, operations 517-519 are performed at operation 506 as illustrated by FIG. 5C. In some embodiments, operations 517-519 are performed by one or more computing devices.

At operation 517 light is applied to the desired 3-D body shape to determine a 3-D brightness gradient (or shadowing) created by the desired 3-D body shape. Next, at operation 518 a 2D image of the 3-D brightness gradient is created. After operation 518, operation 519 is performed. At operation 519, a brightness gradient based on the 2D-image of the brightness gradient is applied to the flat pattern to form the adjusted pattern. Accordingly, during operations 517-519, the pattern is shaded to show the brightness gradient that would be created on the flat pattern as if it were being worn by a body with the desired 3-D body shape. Anatomy shading as directly applied to a garment and not to a pattern is discussed in more detail in U.S. patent application Ser. No. 14/517,339, filed Oct. 17, 2014, which claims priority to U.S. Provisional Application Ser. No. 61/892,749, filed Oct. 18, 2013, which are both hereby incorporated by reference herein in their entirety. The principles discussed therein for creating shading may illuminate how the shading is applied to a pattern or an adjusted pattern herein.

Figure 5D:
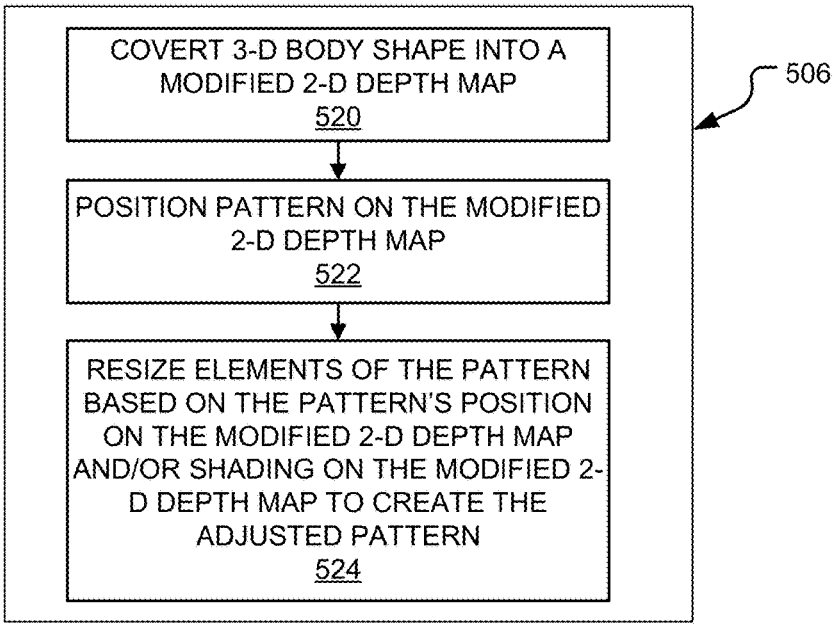

Halftoning the pattern involves adjusting the size of the pattern elements based on the desired 3-D body shape. For example, when one or more selected shaping effects includes halftoning, operations 520-524 are performed at operation 506 as illustrated by FIG. 5D. In some embodiments, operations 520-524 are performed by one or more computing devices.

At operation 520 the 3-D body shape is converted into a modified 2D depth map. The modified 2D depth map is a depth map that has been inverted and contrast adjusted as illustrated by the modified depth map 1600 in FIG. 16. In some embodiments, the modified 2-D depth map is adjusted to account for 3-D brightness gradients of a desired body shape. This is sometimes accomplished by using a grayscale image of the modified 2D depth map.

Next, operation 522 is performed. At operation 522, the identified or selected pattern is positioned on the modified 2D depth map of the desired 3-D body shape. The positioning at operation 522 ensures that the pattern falls over or near a selected feature of a body appropriately when worn.

Figure 14:
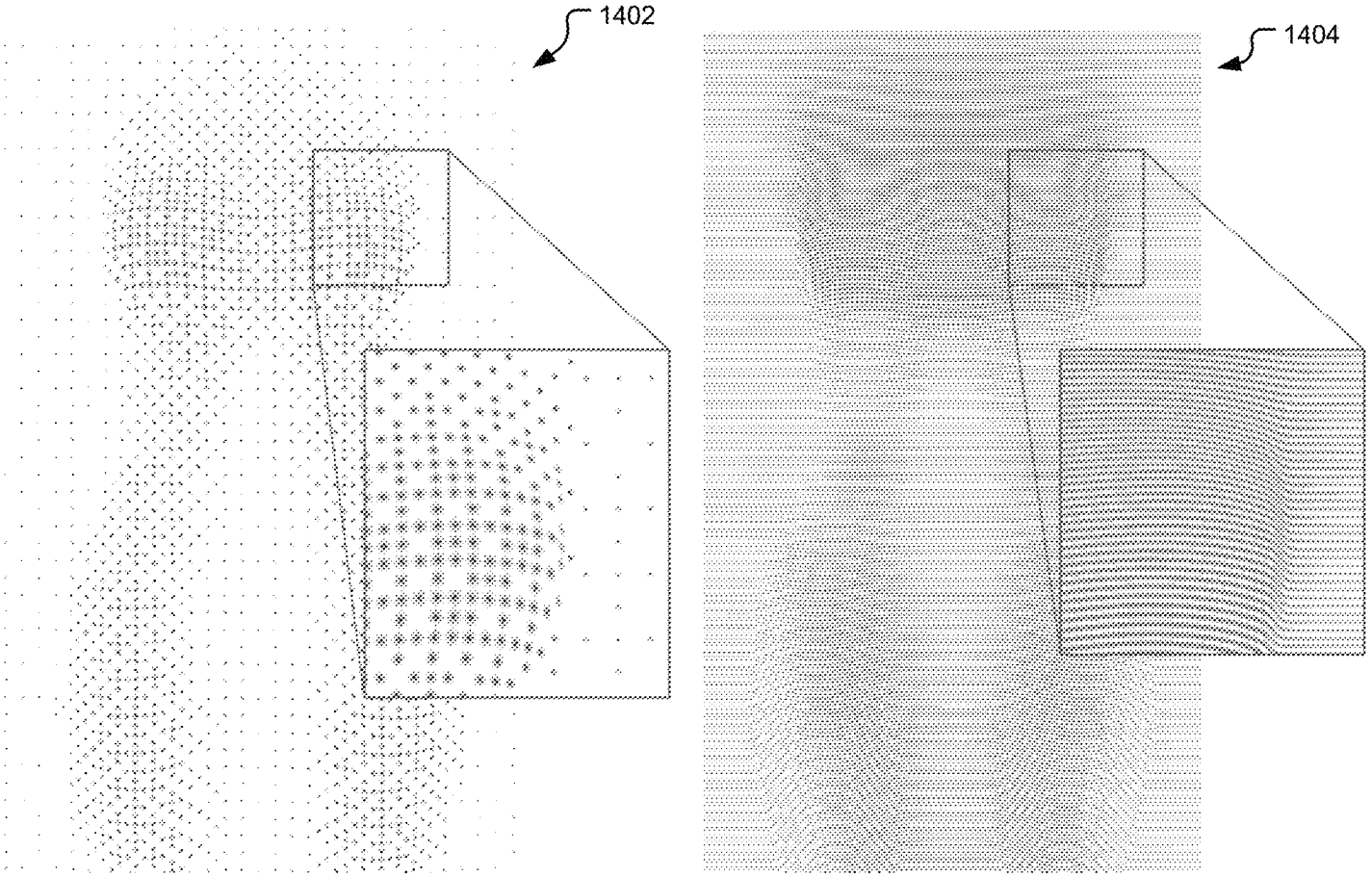
FIG. 14 is a front planar view illustrating 2D images of two different halftoned adjusted patterns, in accordance with an aspect of the disclosure.

After the performance of operation 522, operation 524 is performed. At operation 524, elements of the pattern are resized based on the flat pattern's position on the modified 2D depth map and/or based on the shading on the modified 2D depth map to create the adjusted pattern. Accordingly, in these embodiments, the elements of the pattern are resized according to the modified 2D depth map at operation 522 to show larger pattern elements at brighter spots and smaller pattern elements at darker spots that would be created on the flat pattern if it were being worn by a body with the desired 3-D body shape. For example, FIG. 14 illustrates an adjusted halftoned pattern 1402 and 1404.

Figure 5E:
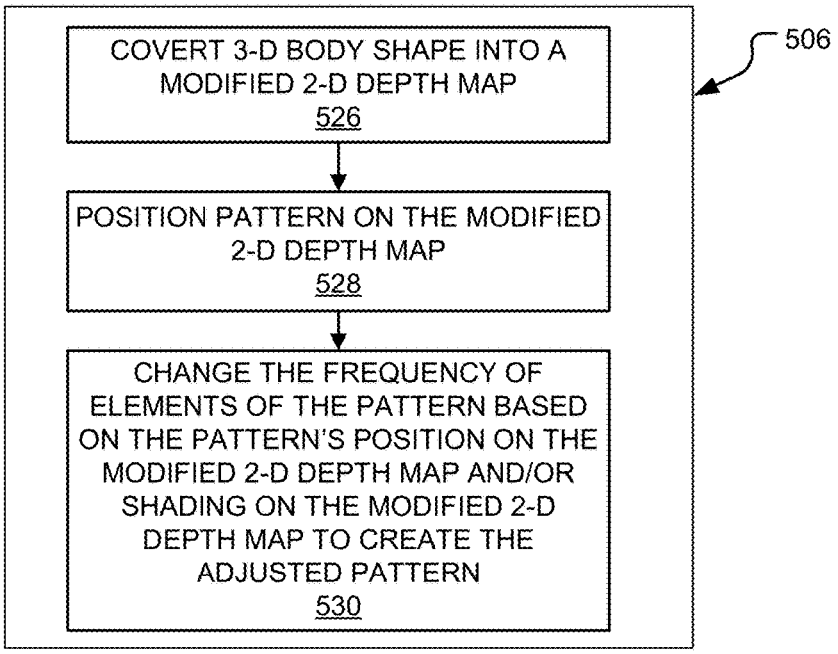

Stippling the pattern involves adjusting the frequency of the pattern elements based on the desired 3-D body shape. For example, when one or more selected shaping effects includes stippling, operations 526-530 are performed at operation 506 as illustrated by FIG. 5E. In some embodiments, operations 526-530 are performed by one or more computing devices.

Similar to the halftoning operation 522, at operation 526 the 3-D body shape is converted into a modified 2D depth map. The modified 2D depth map is a depth map that has been inverted and contrast adjusted as illustrated by the modified depth map 1600 in FIG. 16. In some embodiments, the modified 2D depth map is adjusted to account for 3-D brightness gradients of a desired body shape. This is sometimes accomplished by using a grayscale image of the modified 2D depth map.

Next, operation 528 is performed. At operation 528, the identified or selected pattern is positioned on the modified 2D depth map of the desired 3-D body shape. The positioning at operation 528 ensures that the pattern falls over or near a selected feature of a body appropriately when worn.

Figure 15:
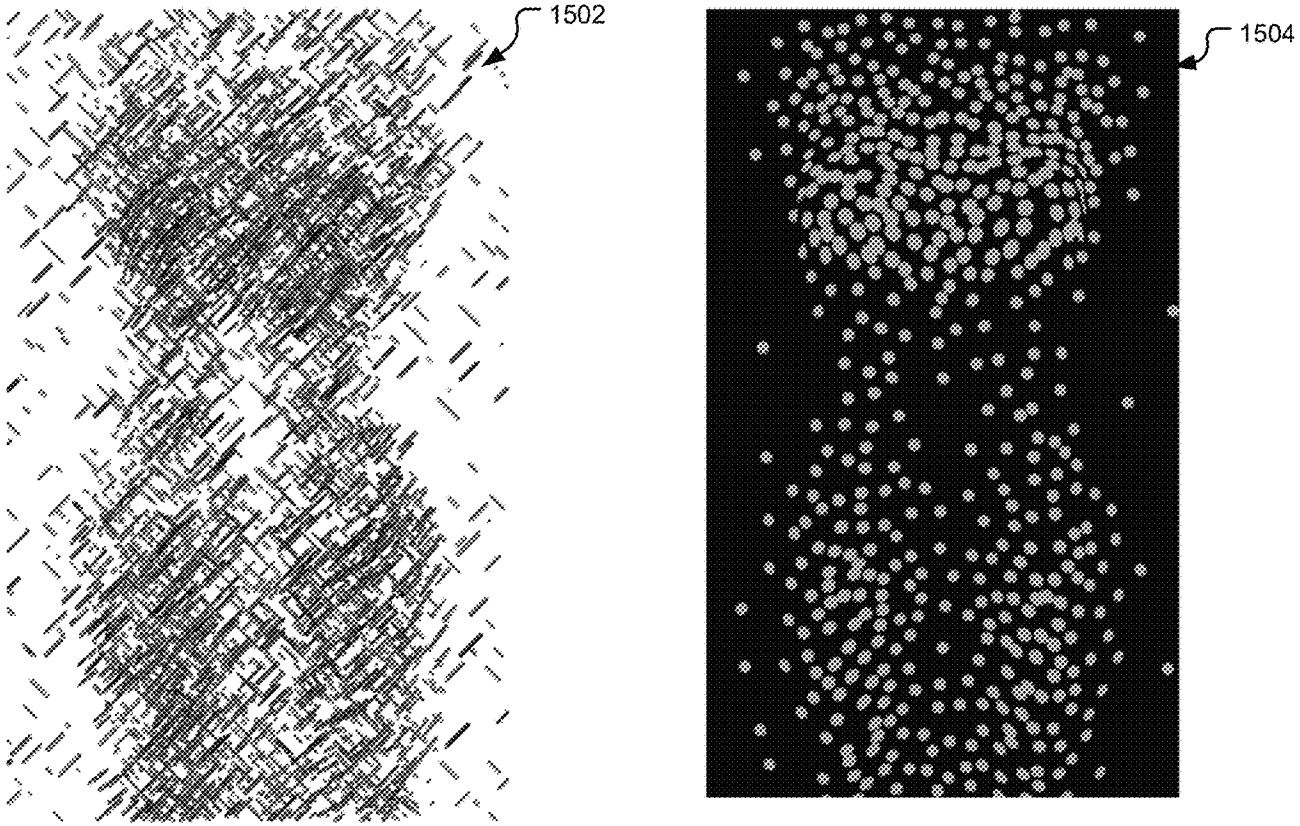
FIG. 15 is a front planar view illustrating 2D images of two different stippled adjusted patterns, in accordance with an aspect of the disclosure.
Figure 16:
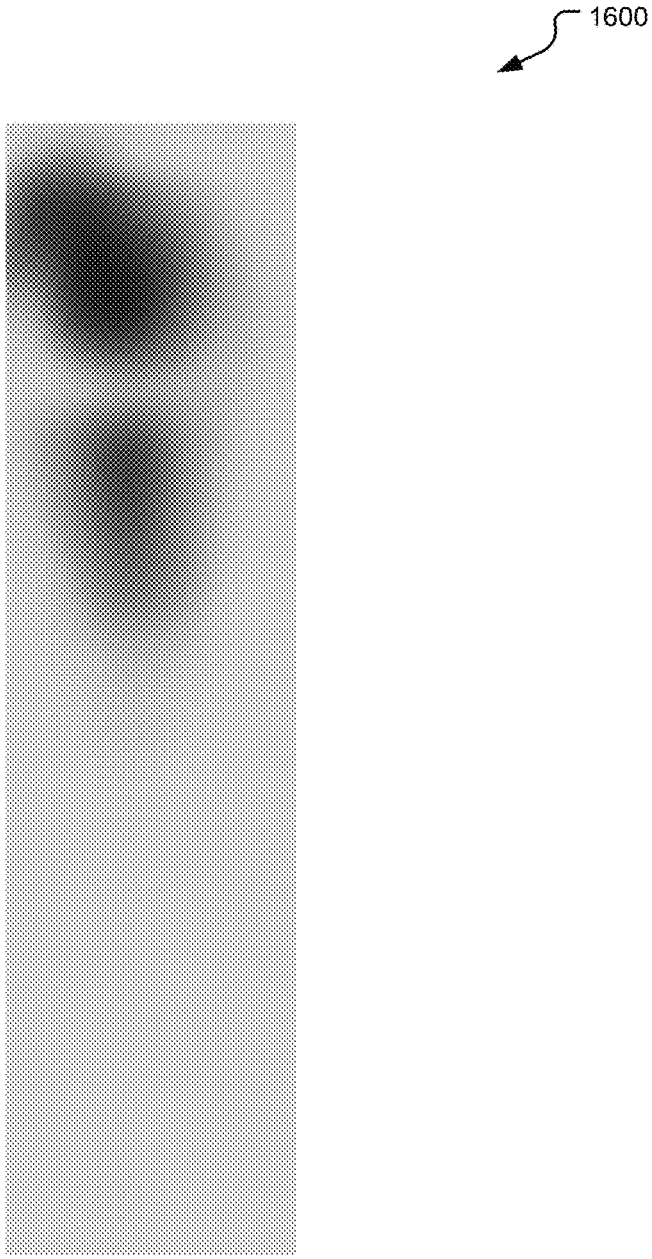
FIG. 16 is a front planar view illustrating a modified depth map of a desired 3-D body shape.

After the performance of operation 528, operation 530 is performed. At operation 530 the frequency of the elements of the pattern are changed based on the flat pattern's position on the modified 2D depth map and/or based on the shading on the modified 2D depth map to create the adjusted pattern. Accordingly, in these embodiments, the frequency of the pattern elements (e.g., the number of pattern elements per unit of area) of the pattern is changed according to the modified 2D depth map at operation 522 to show more pattern elements at brighter spots and less pattern elements at darker spots that would be created on the flat pattern if it were being worn by a body with the desired 3-D body shape. For example, FIG. 15 illustrates an adjusted stippling pattern 1502 and 1504.

While the different shaping effects where discussed individually above, one or more different perspective elements may be utilized in combination. In some embodiments, the halftoning operations 520-524 and/or the stippling operations 526-530 are performed before the warping operations 512-516. In other embodiment, the shading operations 517-519 may be performed before or after any of the other shaping effect operations. For example, FIG. 8 illustrates a 2D image of a warped and shaded adjusted pattern 806. For example, FIG. 9 illustrates a modified 2D depth map 902 of a desired body shape that is utilized to form the halftoned pattern 904. Next, a 2D depth map is utilized to displace or anatomy warp the halftoned pattern 904 to form a 2D image of the halftoned and warped adjusted pattern 906. Next, a body-enhancing garment 908 is created based on the 2D image of the warped and halftoned adjusted pattern 906.

In some embodiments, a consumer may further adjust a pattern formed during operation 506. This input may come from an adjustment task where the consumer can adjust the pattern on a simulated garment to provide different warping, shading, stippling, and/or halftoning. For example, the consumer may move a slider left or right, where left simulates less warping, shading, stippling, and/or halftoning and right simulates more warping, shading, stippling, and/or halftoning of the pattern. Consumer preferences are then accumulated to inform the preferred amount of adjustment to apply to the pattern during operation 506.

After operation 506, operation 508 is performed. At operation 508, a 2D image of the adjusted pattern is created. In some embodiments, operation 508 is performed by one or more computing devices. In some embodiments, where at least one of the perspective elements is warping, the 2D is image is created utilizing perspective projection. The formed 2D image provides a template for adding and/or applying the adjusted pattern to a garment that changes the perception of the identified feature towards the appearance of the desired 3-D body shape. For example, FIG. 4 illustrates an example of the 2D image of a flat pattern 402 (or conventional pattern 402) and the 2D image of the adjusted pattern 406 created utilizing perspective projection from a 2D depth map. In another example, FIG. 8 illustrates an example of the 2D image of a flat pattern 802 (or conventional pattern 802), the 2D image of the adjusted pattern 804, and a further 2D image of adjusted pattern 806. In further example, FIG. 9 illustrates an example a 2D image of adjusted patterns 904 and 906.

At operation 510, the 2D image of the adjusted pattern is applied to a garment or utilized as a template for applying the adjusted pattern to a garment to form a body-enhancing garment. In some embodiments, the adjusted pattern is applied to the garment with a machine, such as laser or printer, and/or in an automated assembly process. In other embodiments, the adjusted pattern is manually added to the garment. In alternative embodiments, the adjusted pattern is formed manually and via a machine.

Figure 10:
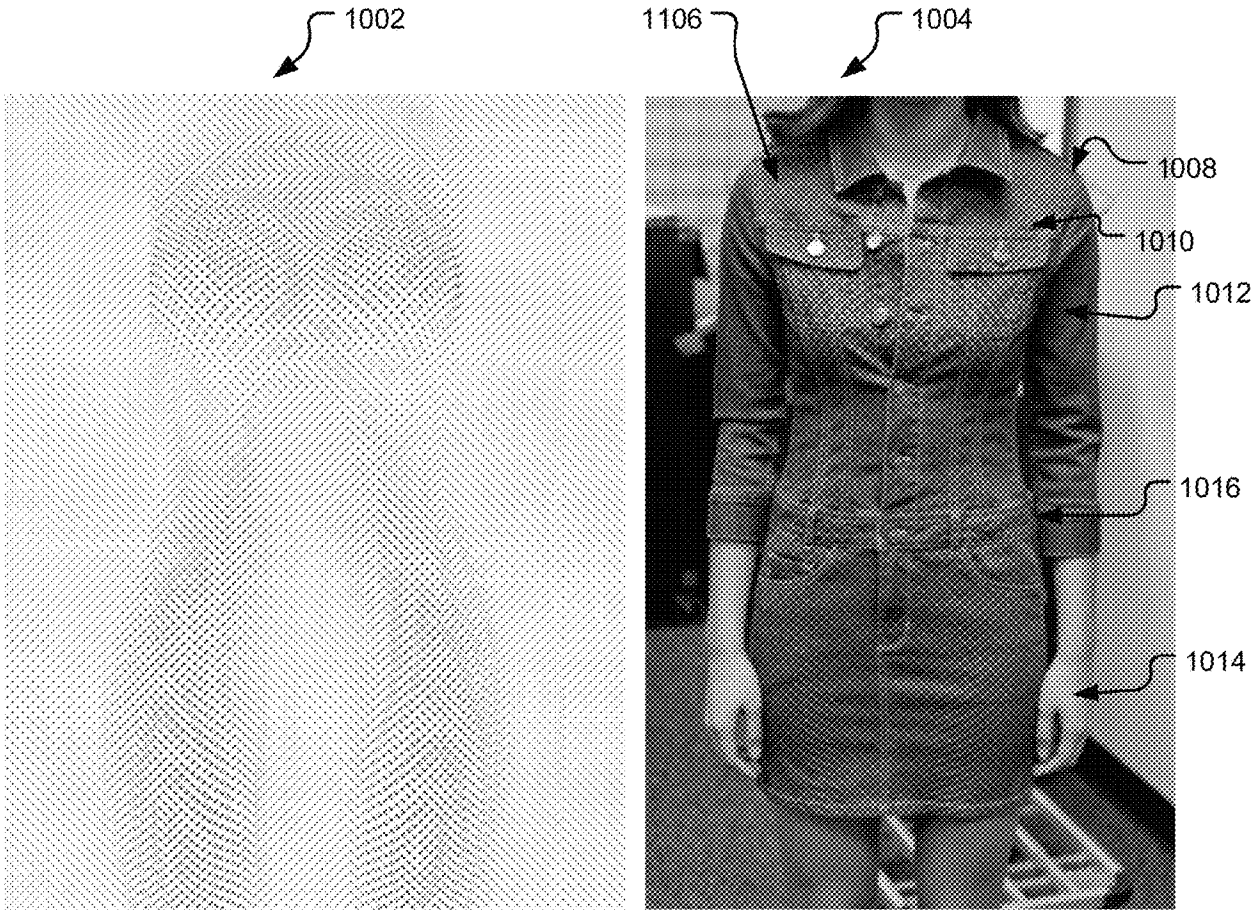
FIG. 10 is a front planar view illustrating the 2-D image of an anatomy warped and halftone adjusted pattern and the application of the 2D image of the halftoned and warped adjusted pattern to a garment to create a body-enhancing garment, in accordance with an aspect of the disclosure.

For example, FIG. 9 illustrates a body-enhancing garment 908. Additionally, FIG. 10 illustrates the application of 2D image of the adjusted pattern 1002 to a garment to form a body-enhancing garment 1004. The adjusted pattern 1002 is a pattern that has been adjusted with warping and shading. In some aspects, an adjusted pattern is applied to a garment by adding or removing one or more colors, through sewing, knitting patters, by perforating the garment and/or etc. As such, adjusted patterns may be created by details added to garment instead or in addition to color changes on a garment. However, as known by a person of skill in the art, an adjusted pattern may be added to a garment utilizing any known pattern techniques.

In other embodiments, operation 510 includes modifying the adjusted pattern before application to the garment to ensure that the applied adjusted pattern emulates the brightness gradients, curves, and/or shading that would be created by the flat pattern on a garment when worn by the desired 3-D body shape. For example, the adjusted pattern may be modified so that the pattern adjustments are applied to the garment in the correct position, size, and intensity. In some embodiments, as discussed above, the brightness gradient, stippling, warping, and/or halftoning may be modified based on the size of the garment. For example, smaller sizes may receive brighter brightness gradients, more stippling, warping, and/or more halftoning than larger sizes. In other embodiments, the brightness gradient, stippling, and/or halftoning may be adjusted or calibrated based on the visible contrast range of a garment or pattern. In still further embodiment, the adjusted pattern may be modified after visible inspection of the garment with an applied adjusted pattern while being worn by a model or mannequin. These visual inspections ensure that the adjusted pattern when applied to the garment when worn emulate the desired 3-D body shape's curves and shading.

Figure 11:
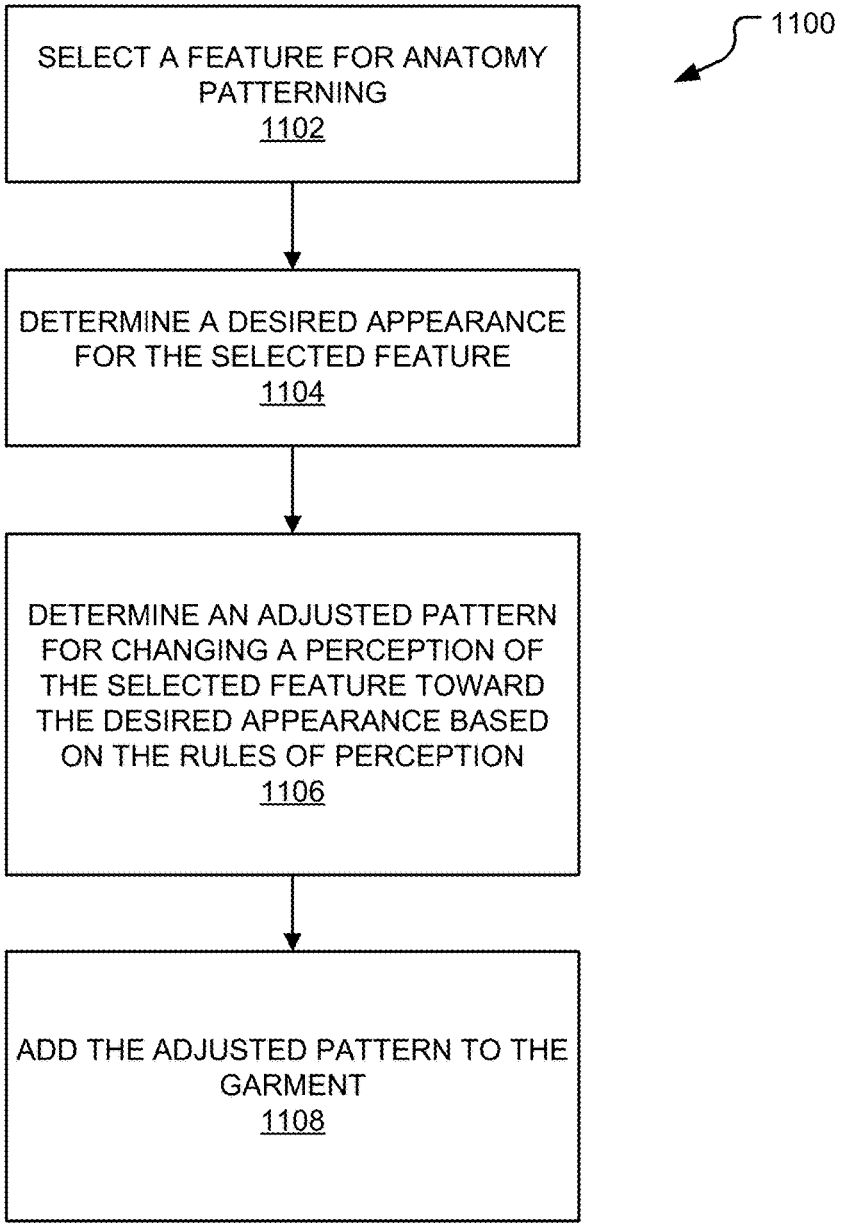
FIG. 11 is a flow diagram illustrating a method for designing an anatomy-patterned garment or a body-enhancing garment, in accordance with an aspect of the disclosure.

In some embodiments, a method 1100 for designing an anatomy-patterned garment is disclosed as illustrated in FIG. 11. The method 1100 includes: selecting a feature for anatomy patterning at operation 1102; determining a desired appearance for the selected feature at operation 1104; determining an adjusted pattern for changing a perception of the selected feature toward the desired appearance based on the rules of perception at operation 1106; and adding the adjusted pattern to the garment at operation 1108. Operation 1106 may include determining the positioning of the adjusted pattern on the garment and/or determining the sizing of the adjusted pattern on the garment.

In some embodiments, the amount of warping, shading, halftoning, and/or stippling of the pattern is determined or adjusted based on consumer feedback during the determining of the adjusted pattern. For example, the amount of warping, shading, and/or halftoning of the adjusted pattern may be determined by utilizing an adjustment task where consumers may adjust the amount of patterning on a simulated garment. For example, the consumer may move a slider left or right, where left simulates less warping, shading, and/or halftoning and right simulates more warping, shading, and/or halftoning of the pattern. Consumer preferences are then accumulated to inform the preferred amount of adjustments to apply to the pattern.

Figure 12:
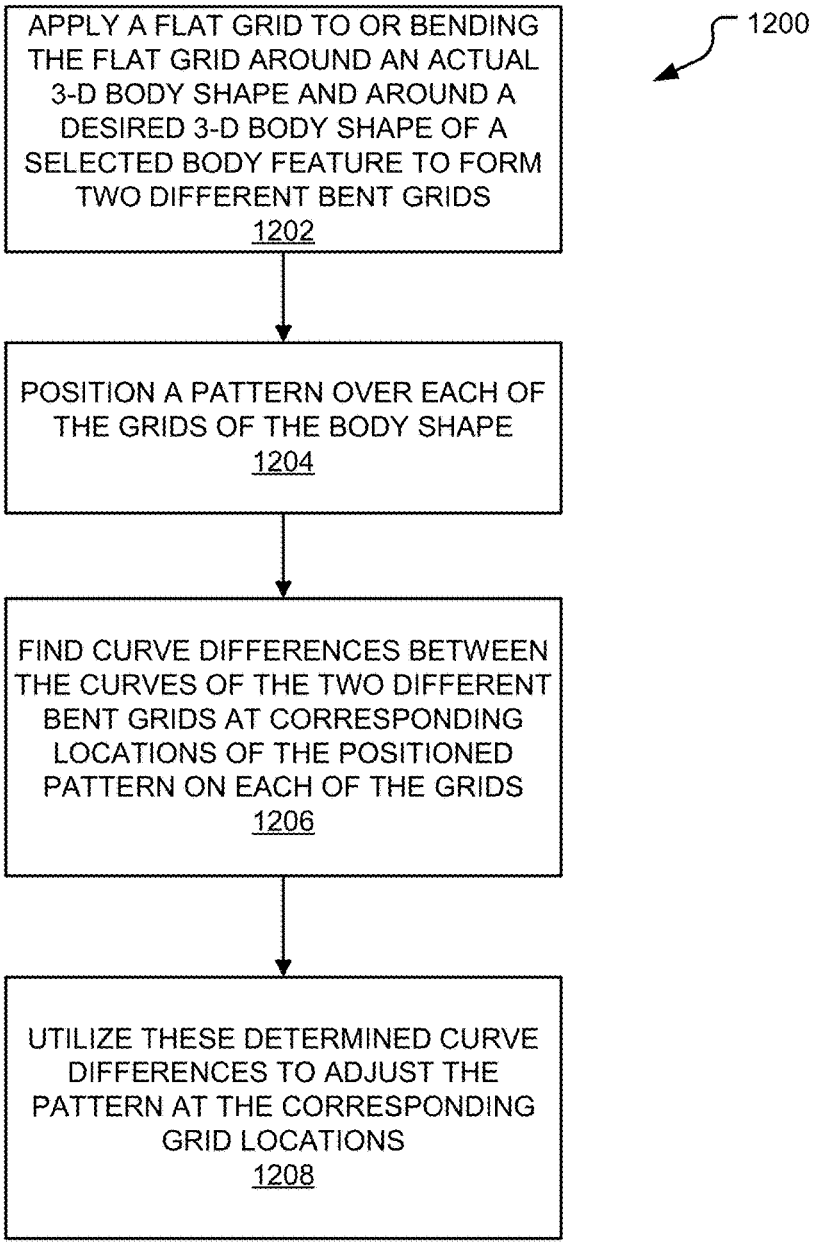
FIG. 12 is a flow diagram illustrating a method for designing an anatomy-patterned garment or a body-enhancing garment, in accordance with an aspect of the disclosure.

In further embodiments, a method 1200 for designing an anatomy-patterned garment is provided as illustrated in FIG. 12. The method 1200 includes: applying a flat grid to or bending the flat grid around an actual 3-D body shape and around a desired 3-D body shape of a selected body feature to form two different bent grids at operation 1202; positioning a selected pattern over each of the grids at operation 1204; finding curve differences between grid positions of the two different bent grids at corresponding locations of the positioned selected pattern on each of the grids at operation 1206; and utilizing these determined curve differences to adjust the pattern at the corresponding grid locations at operation 1208.

In further embodiments, an adaptive genetic algorithm may be utilized to determine the amount of warping, shading, and/or halftoning for a selected pattern to adjust the pattern. The adaptive genetic algorithm utilizes data from various test subjects to find the most desired pattern adjustment on a garment for a specific feature of the wearer. In this process, subjects are given a random set of different garments illustrating a specific feature (i.e., buttocks, chest, legs, waist, etc.) of the wearer with various different pattern adjustments that change the appearance of these features of the wearer. The subjects are then asked to select a garment or garments from the group that is most attractive or best demonstrates the desired feature. The algorithm then modifies the garments based on the previous selections containing different pattern adjustments to change the appearance of the wearer and asks the same subjects to again select the garment or garments from the group that is most attractive or best demonstrates the desired feature. Each pattern adjustment is specifically created to alter the appearance of wearer based on the rules of perception. This process is performed repeatedly. In some embodiments, the algorithm converges on the most attractive or most desired the amount of warping, shading, and/or halftoning of the pattern for a garment located over or near a particular feature after about 20 generations or trials. However, any suitable system or method may be utilized to adjust the amount of warping, shading, and/or halftoning of the pattern based on the rules of perception for anatomy patterning.

Surprisingly, similar amounts of warping, shading, halftoning, and/or stippling are found to increase attractiveness of the wearer when applied across a variety garment sizes and styles. Additionally, similar amounts of warping, shading, halftoning, and/or stippling are found to increase attractiveness of the wearer when applied across different ethnicities and geographic regions with only small differences, such as China and the United States.

The adjusted pattern on a garment, as discussed above, utilizes the rules of perception to change the appearance of a feature of the wearer. While the above examples adjust curves, angles, widths, heights, shading, sizing and/or etc. of a pattern to change the perception of body features, these adjustments should be subtle enough that the brain interprets the adjustments as being created by the shape of the wearer instead of attributing them to the garment itself. For example, changes to a flat pattern that are too large or too extreme are interpreted by the brain as being attributed to the garment itself instead of the wearer. These types of pattern changes that are attributed to the garment itself are design choices and may fall outside the definition of anatomy patterning.

While the pattern adjustment discussed above has been illustrated on pants, shirts, and dresses, anatomy patterning can be applied to various different garments, such as skirts, shorts, capris, overalls, skorts, dresses, and etc. While the anatomy patterning discussed above has focused on increased attractiveness, any desired feature ranges/dimensions may be utilized by anatomy patterning to change the perception of any feature toward a desired body shape utilizing the rules of perception. While the above anatomy patterning focused on the legs, buttocks, chest, and waist of the wearer, anatomy patterning can also be applied to change the perception of other features of a wearer, such as the shoulders and/or feet.

Additionally, while anatomy patterning has been described in detail for specific features of female garments, the principles discussed above for anatomy patterning can be applied to various other female garments and various other male garments. Additionally, while the disclosed anatomy patterning were discussed on specific garments and in specific combinations above, any of the disclosed anatomy patterning principles may be utilized alone and/or in any combination on any desired garment. Further, as understood by a person of skill in the art additional anatomy patterning other than discussed above may be utilized to change the appearance of a feature discussed above. Additionally, as understood by a person of skill in the art, additional anatomy patterning may be utilized to change the appearance of the additional features that have not been discussed above.

Figure 13:
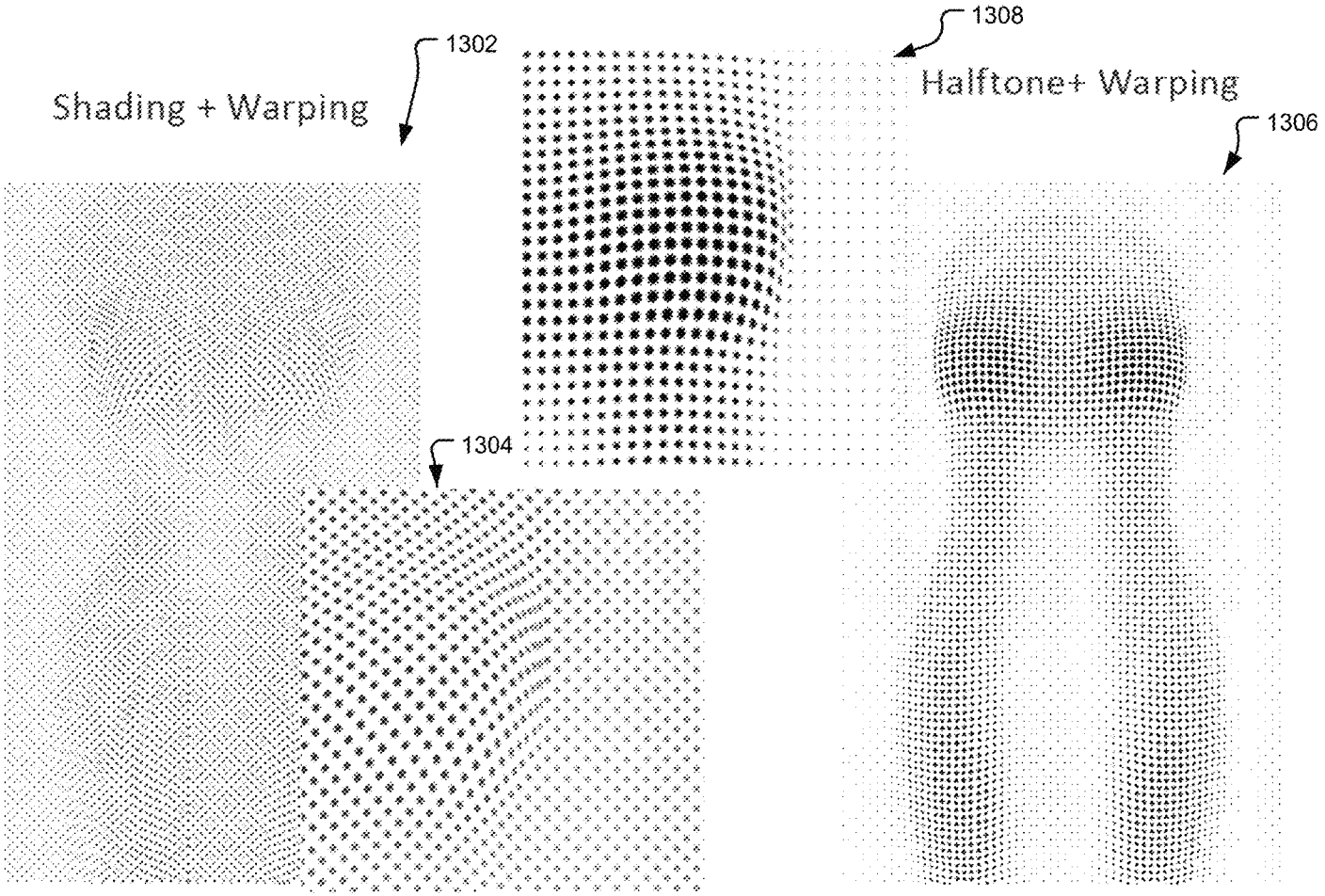
FIG. 13 is a front planar view illustrating a 2D image of a halftoned and warped adjusted pattern and a 2D image of a warped and shaded adjusted pattern, in accordance with an aspect of the disclosure.

FIG. 13 illustrates the difference between a shaded and warped adjusted pattern 1302 and a halftone and warped adjusted pattern 1306. The shaded and warped adjusted pattern 1302 and the halftone and warped adjusted pattern 1306 were both created from the same flat pattern. To highlight the differences between the two different adjustments a magnified view 1304 and 1308 of a portion of the right bosom for each of the adjusted patterns 1302 and 1306 is provided by FIG. 13. The shaded magnified view 1304 of the shaded and warped adjusted pattern 1302 show that each dot in the pattern is approximately the same size, but are bent or displaced to show the curves of a desired body shape. Additionally, the dots in the shaded magnified view 1304 have different brightness and/or darkness based on the desired body shape. In contrast, the halftoned magnified view 1308 of the halftone and warped adjusted pattern 1306 has dots that vary in size. As illustrated, the dots in the halftoned magnified view 1308 are larger where the dots are darker in the shaded magnified view 1304 and smaller where the dots are lighter in the shaded magnified view 1304. The dots in the halftoned magnified view 1308 are similarly displaced or curved based on the desired body shape when compared to the dots in the shaded magnified view 1304. Any desired pattern may be adjusted utilizing the principles of anatomy patterning as disclosed herein.

Body-enhancing garments 908 and 1004 are illustrated in FIGS. 9 and 10. A body-enhancing garment 1004 includes a front side 1006 and rear side 1008 opposite the front side 1006. An adjusted pattern 1010 is displayed on the front side 1006 and/or the rear side 1108 of the body-enhancing garments 1004. The adjusted pattern 1010 may be warped, shaded, halftoned and/or stippled around a first feature (such as the bosom 1012), a second feature (such as the waist 1016), or any number features of the wearer 1014 to change the perceived shape of the body of the wearer 1014 toward a desired shape. As discussed above, a body enhancing garment may be a pair of pants, a shirt, a skirt, a jacket, a pair of shorts, a skirt, a dress, a pair of leggings, a pair of capris, a bra, a piece of underwear, a piece of swim wear, a pair of shoes, a pair of skorts, or any other item of clothing for a human.

Aspects of the present disclosure, for example, are described above with reference to block diagrams and/or operational illustrations of methods, systems, and computer program products according to aspects of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

This disclosure described some aspects of the present technology with reference to the accompanying drawings, in which only some of the possible aspects were described. Other aspects can, however, be embodied in many different forms and the specific aspects disclosed herein should not be construed as limited to the various aspects of the disclosure set forth herein. Rather, these exemplary aspects were provided so that this disclosure was thorough and complete and fully conveyed the scope of the other possible aspects to those skilled in the art. For example, the various aspects disclosed herein may be modified and/or combined without departing from the scope of this disclosure.

Although specific aspects were described herein, the scope of the technology is not limited to those specific aspects. One skilled in the art will recognize other aspects or improvements that are within the scope and spirit of the present technology. Therefore, the specific structure, acts, or media are disclosed only as illustrative aspects. The scope of the technology is defined by the following claims and any equivalents therein.

Various embodiments and/or examples are described above with reference to block diagrams and/or operational illustrations of methods, systems, and computer program products. The functions/acts noted in the blocks may occur out of the order as shown in any flow diagram. For example, two blocks shown in succession may in fact be executed substantially concurrently or the blocks may sometimes be executed in the reverse order, depending upon the functionality/acts involved.

The description and illustration of one or more aspects provided in this application are not intended to limit or restrict the scope of the disclosure as claimed in any way. The embodiments, examples, and details provided in this application are considered sufficient to convey possession and enable others to make and use the best mode of claimed disclosure. The claims should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claims.

What is claimed is:

1. A method for designing a body-enhancing garment, the method comprising:

identifying a 3-D body shape;

identifying a flat pattern for a garment;

applying light to the 3-D body shape to determine a 3-D brightness gradient created by the 3-D body shape upon the application of the light;

creating a gradient 2-D image of the 3-D brightness gradient;

positioning the flat pattern over the gradient 2-D image;

adjusting the pattern to be lighter in portions positioned over lighter portions of the gradient 2-D image and darker in portions positioned over darker portions of the gradient 2-D image to form a shaded pattern that emulates the 3-D brightness gradient created by the 3-D body shape;

converting the 3-D body shape into a 2-D depth map;

positioning the shaded flat pattern on the 2-D depth map; and warping the shaded flat pattern to emulate the dimensions of the 3-D body shape based on the positioning of the shaded flat pattern on the 2-D depth map to create an adjusted pattern; and creating a 2-D image of the adjusted pattern utilizing perspective projection.

2. The method of claim 1, further comprising:

applying the 2-D image of the adjusted pattern to the garment.

* * * * *